United States Patent [19]

Mantel et al.

[11] 4,152,177

[45] May 1, 1979

[54] METHOD OF GAS CARBURIZING

[75] Inventors: Edward R. Mantel, Warren; Edwin J. Miller, Imlay City, both of Mich.

[73] Assignee: General Motors Corporation, Detroit, Mich.

[21] Appl. No.: 765,353

[22] Filed: Feb. 3, 1977

[51] Int. Cl.[2] ..... C21D 1/48

[52] U.S. Cl. ..... 148/16.5; 148/27

[58] Field of Search ..... 148/12.1, 16, 16.5, 148/27

[56] References Cited

U.S. PATENT DOCUMENTS

| | | | |
|---|---|---|---|
| 2,161,162 | 6/1939 | Harsch | 148/16.5 |
| 2,184,972 | 12/1939 | Darratt | 148/16.5 |
| 2,275,133 | 3/1942 | Davis | 148/16.5 |
| 2,287,651 | 6/1942 | Turin | 148/16.5 |
| 2,827,407 | 3/1958 | Carlson et al. | 148/16.5 |
| 3,796,615 | 3/1974 | Westeren et al. | 148/16.5 |
| 3,925,109 | 12/1975 | Nilsen | 148/16.5 |

OTHER PUBLICATIONS

Metals Handbook, 8th Ed., vol. 2, 197, pp. 93 & 104–107.

*Primary Examiner*—L. Dewayne Rutledge
*Assistant Examiner*—John P. Sheehan
*Attorney, Agent, or Firm*—George A. Grove

[57] ABSTRACT

Gas carburizing is carried out in a subsantially closed furnace in an atmosphere initially containing hydrogen with just enough methane (or other suitable hydrocarbon gas) to provide sufficient carbon for carburization at a temperature above the austenitic transformation temperature of a ferrous metal workpiece. For each volume of methane that decomposes at the surface of the workpiece in the carburization process, two volumes of hydrogen are generated. A small amount of natural gas is fed into the furnace to maintain the carbon content of the atmosphere, and a small quantity of the predominantly hydrogen carburizing mixture is bled from the furnace to maintain a desired pressure.

3 Claims, 1 Drawing Figure

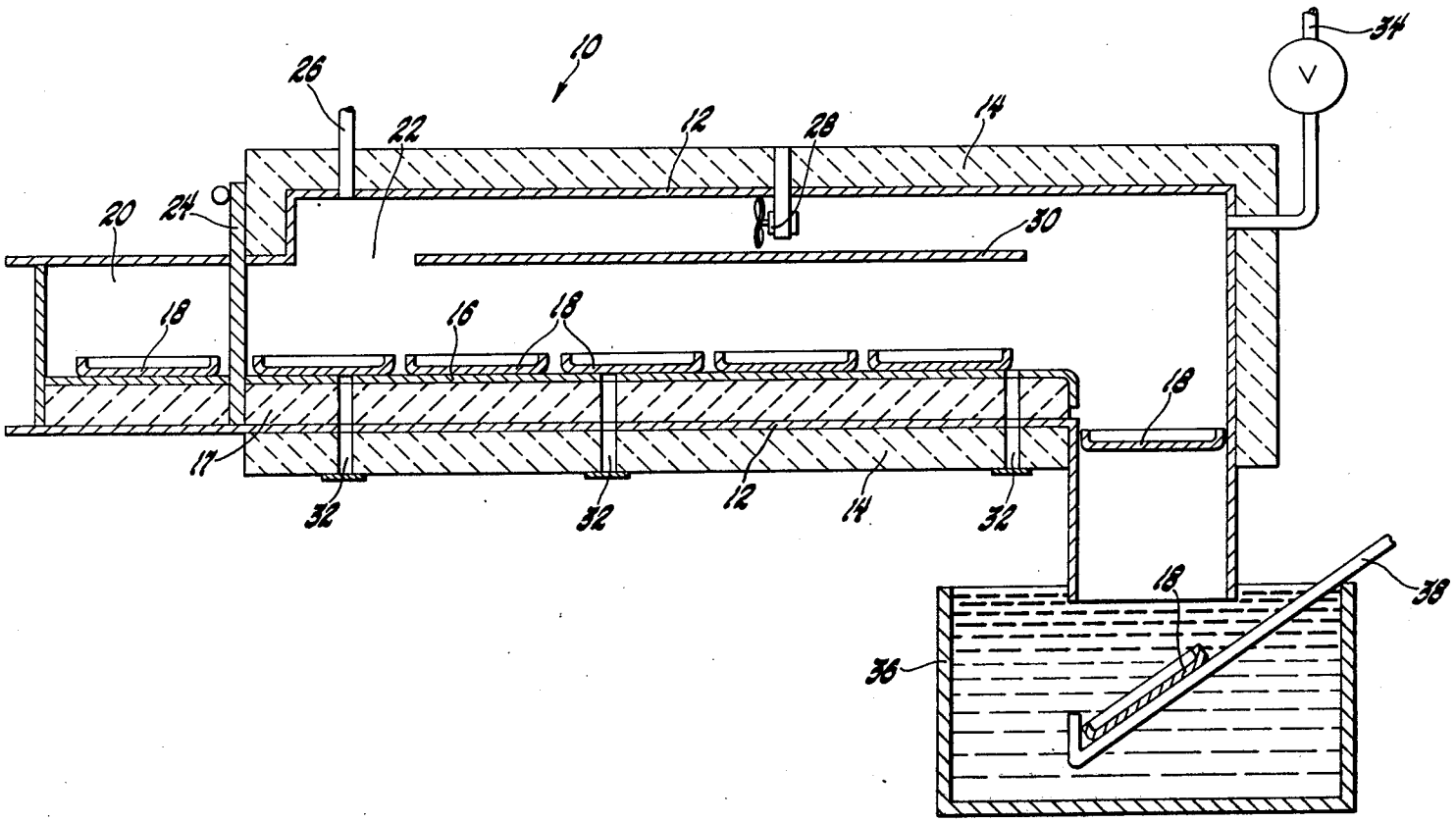
34
38
18
18
50
14
32
36
14
28
12
12
10
32
18
16
22
26
32
24
17
18
20

METHOD OF GAS CARBURIZING

This invention relates to gas carburizing of ferrous metal workpieces. More particularly, it relates to a method of gas carburizing using natural gas (predominantly methane), or other suitable hydrocarbon, as the source of carbon and hydrogen as the carrier gas and which is not wasteful of the hydrocarbon.

Most gas carburizing processes now practiced on ferrous metal workpieces employ a hydrocarbon source of carbon in a carrier gas. The source of carbon may be natural gas. The carrier gas is usually the product of a catalyzed partial combustion of natural gas or other hydrocarbon in air that produces a closely controlled mixture of carbon monoxide, carbon dioxide, water, nitrogen and hydrogen. It is known in the art as endothermic gas. Thus, a scarce hydrocarbon gas is consumed both in making the carrier gas and in serving as a source of carbon.

It is common practice to slowly pass batches of many ferrous metal workpieces through large furnaces maintained at 1700° F. or higher to carry out the carburization. In order to maintain uniform and desired carbon potential at the surface of the workpieces the carburizing atmosphere, including the carrier gas and carbon source, is caused to rapidly circulate within and flow through the furnace. Large volumes of gas are involved. The gas is exhausted before all of the hydrocarbon gas is consumed. Much scarce hydrocarbon gas is wasted.

It is an object of the present invention to provide a method of gas carburizing low carbon steel and other ferrous metal workpieces using as the carburizing atmosphere a mixture of hydrogen and methane or other suitable hydrocarbon gas. In the method the carburizing atmosphere is circulated and confined within the furnace, and hydrocarbon gas (containing no carrier gas) is added directly to the furnace as required to maintain carbon potential. Gas is removed from the furnace only as necessary to prevent pressure buildup due to the formation of hydrogen during carburization.

In accordance with a preferred embodiment of our invention, this and other objects and advantages are accomplished by initially providing a carburizing furnace adapted for the passage of ferrous metal workpieces therethrough while confining a carburizing atmosphere such that small amounts of makeup natural gas can be admitted to maintain a desired methane to hydrogen ratio and small amounts of the carburizing atmosphere mixture can be bled out to prevent pressure buildup as hydrogen is generated in the carburizing process. As workpieces are admitted to the furnace they are heated to a suitable carburizing temperature above their austenitic transformation temperature. In the case of many low carbon alloyed and nonalloyed steels, a temperature of above 1700° F. is suitable. A temperature of about 1950° F. is preferred to accelerate the carburizing process. At the start-up of a carburizing operation in accordance with our process the furnace atmosphere initially consists predominantly of hydrogen with a sufficient concentration of natural gas or methane to provide suitable carburizing potential. Typically, a mixture of 80% hydrogen and 20% methane is suitable. At the carburizing temperature, for example 1950° F., the methane rapidly decomposes at the surface of the ferrous metal workpieces. Carbon is formed on the surface and diffuses into the workpiece. For each volume of methane so consumed two volumes of hydrogen are generated. As carburization proceeds, the volume of gas in the closed furnace tends to increase and the pressure builds up. However, the concentration of methane decreases. Accordingly, a small amount of the gaseous hydrogen-rich mixture is bled from the furnace to prevent excessive pressure buildup. Undiluted natural gas or methane is admitted to the furnace to maintain a methane concentration in the furnace of 1% to 20% by volume of the atmosphere.

The gas in the furnace is preferably circulated to maintain a uniform methane concentration at the surface of the workpieces. The total volume of the gas need not be great, but only sufficient to provide adequate available carbon for the quantity of workpieces. In the operation of the furnace, after start-up only methane or natural gas is admitted and a relatively small amount of the carburizing mixture is exhausted to prevent pressure buildup. Most of the carbon introduced into the furnace in the hydrocarbon gas ends up in the workpieces. Very little is exhausted from the furnace.

After the workpieces have been in the furnace long enough to obtain a carburized case of suitable carbon content and depth the pieces are removed from the furnace into a quench bath or other desired processing apparatus.

In an especially preferred embodiment of our invention, the carburized atmosphere is bled from the furnace through a suitable filter which is pervious to hydrogen, but not methane, so that only hydrogen is vented from the furnace and methane is conserved.

A better understanding of the practice of our invention and the advantages thereof will be had from a detailed description thereof which follows. In the description reference will be made to the DRAWING which is a schematic view in section of a furnace and associated apparatus suitable for practicing our method.

As an example, the carburization of ball bearing races formed of SAE 4118 steel will be described. They typically require carburization to obtain a hardness of 50 Rc at a minimum depth of 0.035 inch. Referring to the DRAWING, an elongated furnace 10 may be employed having a heat resistant metal alloy or ceramic inner shell 12 enclosed in an insulated ceramic jacket 14. The furnace has a bed 16 over a refractory floor 17, along which workpieces are moved in trays 18 or racks, or on a conveyor or other suitable means. It is also provided with an entrance vestibule 20 into which workpieces are introduced and from which air can be purged before the workpieces are introduced into the carburizing region 22 of the furnace. A sealable gate 24 is interposed between the vestibule 20 and the carburizing region 22. After the vestibule has been evacuated or purged of air and back-filled with hydrogen, the gate 24 is opened and the workpieces introduced into the carburizing region 22. Electrical resistance heating means, not shown, is employed to heat the workpiece and the furnace atmosphere to a suitable carburizing temperature, preferably about 1950° F. for the steel races. Initially, the furnace atmosphere is made up to consist of 80% by volume hydrogen and 20% by volume methane. Gases making up the furnace atmosphere are admitted through gas inlet 26. Mechanical circulation means 28, such as a fan or blower, is employed to promote uniformity of the composition of the carburizing atmosphere. The circulation also conveys the carburizing component to all surfaces of the workpieces. A partition member 30 disposed horizontally and lengthwise of the furnace serves to promote a circular flow of the carburizing atmosphere in the furnace. In the DRAWING the bulk flow of the hydrogen carrier gas and hydrocarbon gas is counterclockwise. In the vicinity of the workpieces (not shown, but carried on trays 18) it flows in the same direction that they are moved through the furnace.

At 1950° F. methane decomposes rapidly at the surface of the SAE 4118 steel workpieces forming carbon and hydrogen. Two volumes of hydrogen are formed per volume of methane that decomposes. Sample ports 32 are provided in the furnace for monitoring the composition of the carburizing gases. Natural gas or pure methane is admitted to the furnace through inlet means 26 only as required to maintain a suitable desired carburizing potential. In order to prevent excessive pressure buildup due to the formation of hydrogen, a small portion of the mixture of carburizing gases, predominantly hydrogen, is allowed to intermittently bleed or burp from the furnace through pressure regulated gas outlet means 34. In the operation of carburizing the SAE 4118 steel the methane content of the atmosphere is preferably maintained at about 5% to 10% by volume of the methane-hydrogen mixture and suitably 1% to 20% by volume.

The workpieces (not shown) on trays 18 are slowly shoved or otherwise moved through the furnace such that they have a residence time of about thirty minutes at 1950° F. They fall from the furnace into a quench tank 36 of suitable quenching oil. They are removed from the quench tank by suitable mechanical means indicated at 38.

It was found that carburizing for thirty minutes in the natural gas and hydrogen atmosphere at 1950° F. enabled the part to be hardened to 50 Rc at a minimum depth of 0.035 inch. In a sixty minute carburizing run under the same conditions a 50 Rc case was obtained at a depth of 0.055 inch. When parts are carburized at 1950° F. and quenched it is usually desirable to reheat to a lower austenitizing temperature (e.g., 1600° F.) for a short time for grain refinement and required hardness. The overall time requirement for our carburizing process at 1950° F. and subsequent reheat is about 75% less than that required by present production practice using an endothermic carrier atmosphere at 1700° F.

In accordance with our method the hydrocarbon gas component providing the carbon is fed to the furnace as required to maintain a desired carburizing rate. Most of the carbon input ends up in the workpiece. Only a small amount is released from the furnace (mixed with the hydrogen carrier gas) to prevent excessive pressure buildup in the furnace as the carburization proceeds. No hydrogen carrier gas needs to be added after the process has been started up. Hydrogen is generated upon decomposition of the methane or other hydrocarbon. If a filter system is employed which permits selective bleeding off of hydrogen formed during carburizing little or no methane need be lost.

We prefer to use natural gas or methane as the source of carbon in our carburizing process. At suitable temperatures of 1650° F. and above, methane readily cracks or decomposes at the surface of a hot ferrous metal workpiece to ultimately form elemental carbon and two molecules of hydrogen. The methane content of the hydrogen-methane mixture can be easily maintained at a level which provides rapid carburization of the workpiece but little or no sooting of the furnace. In short, the use of methane is clean and introduces little, if any, complications in the chemistry of the atmosphere or the carburizing operation. Unlike endothermic atmospheres, the hydrogen-methane atmosphere can readily be used at temperatures approaching 2000° F. In fact, it is preferred to carry out our process at about 1950° F. or higher. Other hydrocarbons such as ethane, propane, butane, etc., may be used in our process. However, they are more likely than methane to form soot on furnace surfaces. Furthermore, they contain more carbon per molecule than methane. This may lead to a greater loss of carbon from the furnace upon bleeding of the atmosphere than is suffered with methane. The hydrocarbon content should be no more than 20% by volume of the furnace atmosphere. When methane is used the content is preferably 5% to 10% and suitably in the range of 1% to 20% by volume.

Our process is applicable to low carbon, alloyed or unalloyed steels and other ferrous metal compositions which need to be carburized. The process may be carried out at the carburizing temperatures previously employed in the carburizing art, e.g., about 1700° F. However, it is preferable to practice our process to carburize rapidly at temperatures of about 1950° F. so that the size of the furnace and thus the volume of the carburizing atmosphere at any given time can be minimized. Furthermore, obviously workpiece through-put is increased at higher carburizing temperatures.

As is apparent from the description of our process, no methane need be employed in producing the carrier gas. The prior art endothermic carrier gases require large amounts of methane for their manufacture. Only an initial supply of hydrogen need be made available for start-up purposes. After start-up no separate carrier gas system or control is required. In our process the carrier or dilution gas (hydrogen) is generated during the carburization operation. The carburizing procedure may be carried on for over prolonged periods simply by feeding natural gas through a gas line into the furnace interior. The carrier and hydrocarbon gases should be circulated within the furnace to assure uniformity of composition and of carbon potential in the surface of the workpiece. The bleeding of gas from the furnace to maintain desired pressure (usually only slightly above atmospheric pressure) should be at a place where the atmosphere is of average or less than average methane content so that methane is not wasted.

While our invention has been described in terms of a preferred embodiment thereof, it will be appreciated that other forms thereof could readily be adapted by one skilled in the art. Accordingly, the scope of our invention is to be limited only by the following claims.

What is claimed is:

1. In the method of gas carburizing ferrous metal based workpieces wherein such workpieces are treated in a furnace in which a gaseous carburizing atmosphere is contained and the workpieces are heated at a carburizing temperature above the austenitic transformation temperature of the ferrous composition for a time until carbon has been introduced into said workpieces in a desired amount and to a desired depth, the improvement comprising employing as the carburizing atmosphere at the start-up of a carburizing operation a gaseous mixture consisting of hydrogen and a hydrocarbon gas that decomposes to form products comprising carbon and hydrogen upon contacting said heated workpieces, said gas being present in a concentration of about 1% to 20% by volume of said mixture and being consumed as workpieces are moved through the furnace with the concomitant formation of hydrogen, and thereafter adding only a said hydrocarbon gas to the atmosphere of the furnace to maintain a desired carburizing potential in said concentration range while bleeding a portion of the gaseous atmosphere from the furnace as necessary to maintain a predetermined desired pressure.

2. In the method of gas carburizing ferrous metal based workpieces wherein such workpieces are moved through a furnace in which a gaseous carburizing atmosphere is contained and the workpieces are heated at a carburizing temperature above the austenitic transformation temperature of the ferrous composition for a time until carbon has been introduced into said workpieces in a desired amount and to a desired depth, the improvement comprising employing as the carburizing atmosphere at the start-up of a carburizing operation a gaseous mixture consisting of hydrogen and methane, the methane being present in a concentration of about 1% to 20% by volume of said mixture and being consumed as workpieces are moved through the furnace with the concomitant formation of hydrogen, and thereafter adding only methane to the atmosphere of the furnace to maintain a said methane concentration in said atmosphere while bleeding a portion of the gaseous atmosphere from the furnace as necessary to maintain a predetermined desired pressure.

3. In the method of gas carburizing ferrous metal based workpieces wherein such workpieces are moved through a furnace in which a gaseous carburizing atmosphere is contained and the workpieces are heated at a carburizing temperature above the austenitic transformation temperature of the ferrous composition for a time until carbon has been introduced into said workpieces in a desired amount and to a desired depth, the improvement comprising employing as the carburizing atmosphere at the start-up of a carburizing operation a gaseous mixture consisting of hydrogen and natural gas, the natural gas being present in an amount to provide a methane concentration of about 1% to 20% by volume of said mixture and being consumed as workpieces are moved through the furnace with the concomitant formation of hydrogen, and thereafter adding only natural gas to the atmosphere of the furnace to maintain a desired carburizing potential in said concentration range while bleeding a portion of the gaseous atmosphere from the furnace as necessary to maintain a predetermined desired pressure.

* * * * *